US007290681B2

(12) United States Patent
Decottignies et al.

(10) Patent No.: US 7,290,681 B2
(45) Date of Patent: Nov. 6, 2007

(54) DISTRIBUTOR AND PUSH-BUTTON COMPRISING ONE SUCH DISTRIBUTOR

(75) Inventors: Laurent Decottignies, Cergy (FR); Yann Gallois, Tillières-sur-Avre (FR); Yannick Hervé, Breteuil-sur-Iton (FR)

(73) Assignee: Airlessystems, Charleval (FR)

( * ) Notice: Subject to any disclaimer, the term of this patent is extended or adjusted under 35 U.S.C. 154(b) by 448 days.

(21) Appl. No.: 10/511,093

(22) PCT Filed: Apr. 14, 2003

(86) PCT No.: PCT/FR03/01184

§ 371 (c)(1),
(2), (4) Date: Oct. 14, 2004

(87) PCT Pub. No.: WO03/086652

PCT Pub. Date: Oct. 23, 2003

(65) Prior Publication Data

US 2005/0127094 A1 Jun. 16, 2005

(30) Foreign Application Priority Data

Apr. 16, 2002 (FR) ..... 02 04812

(51) Int. Cl.
*B05B 11/00* (2006.01)

(52) U.S. Cl. ..... 222/135; 222/137; 239/306

(58) Field of Classification Search ..... 222/135–137, 222/129, 145.1; 239/304, 306–308; 137/594, 137/595, 597

See application file for complete search history.

(56) References Cited

U.S. PATENT DOCUMENTS 4,773,562 A * 9/1988 Gueret ..... 222/135
6,305,578 B1 10/2001 Hildebrandt et al.

FOREIGN PATENT DOCUMENTS

JP 10-211971 A 8/1998
JP 11-59746 A 3/1999

* cited by examiner

*Primary Examiner*—J. Casimer Jacyna
(74) *Attorney, Agent, or Firm*—Sughrue Mion Pllc.

(57) ABSTRACT

A dispenser head (1) for assembly on two parallel, hollow actuator rods, said head being made as a single piece of plastics material and comprising: two parallel coupling sleeves (11, 12) for engaging with respective ones of the actuator rods, the sleeves defining respective inlet ducts (110, 120); a dispenser endpiece (13) defining at least one outlet duct discharging into at least one dispenser orifice (1310, 1320); and a cross member (10) linking the sleeves to the endpiece, the cross member defining at least one connection duct (101, 102) linking the inlet ducts (110, 120) to the outlet duct(s) (1310, 1320), said at least one connection duct extending transversally both relative to the sleeves and relative to the outlet duct(s), said at least one connection duct (101, 102) including an access opening (1010, 1020) closed by a closure element (14, 15),the dispenser head being characterized in that the closure element (14, 15) is made integrally with the remainder (10, 11, 12, 13) of the head.

7 Claims, 1 Drawing Sheet

DISTRIBUTOR AND PUSH-BUTTON COMPRISING ONE SUCH DISTRIBUTOR

BACKGROUND

1. Field

The present invention relates to a dispenser head intended to be assembled on two parallel, hollow actuator rods. The actuator rods are each part of a dispenser component, such as a pump or a valve. The pumps or valves are assembled on different fluid containers so that each dispenser component can take the fluid from its respective container and dispense it along the respective actuator rod to the dispenser head, which includes one or two dispenser orifices(s) from which the fluid mixture can be collected by the user. This type of distributor is better known under the term of "duo" dispenser, frequently found in the field of cosmetics, perfumery, and pharmaceuticals.

2. Description of Related Work

The present invention is applicable more particularly to dispenser heads for assembly on the free ends of actuator rods. The dispenser head can be incorporated or housed in an actuating pusher which can be pressed down using one or more fingers in order to actuate the dispenser components and thus dispense a quantity of fluid mixture. The head may itself form a pusher. This kind of dispenser head must include leaktight coupling means adjusted to cooperate with the free ends of the parallel, hollow actuator rods in the dispenser components. In general, such coupling means come in the form of sleeves engaged by force around the free ends of the rods. Internally, these coupling sleeves define inlet ducts which preferably extend along the axes of the hollow actuator rods. The dispenser head also comprises a dispenser endpiece which defines one or two outwardly-open outlet ducts which form one or two dispenser orifices. The number of outlet ducts and dispenser orifices (one or two) depends on whether the fluids need to be mixed before or after they have been dispensed. One single outlet duct defining one dispenser orifice allows for and leads to the prior mixing of the two fluids inside the head, whereas with two outlet ducts and two dispenser orifices, the fluids will be mixed in part only or not at all after being dispensed, i.e. on leaving the dispenser orifices. The choice of providing one or two outlet ducts depends to a large extent on the type of fluid to be dispensed, and also on the desired effect at the moment of dispensing. Nevertheless, the present invention covers both of these two variants.

In certain dispenser heads, the outlet duct(s) communicate(s) directly with the coupling sleeve inlet ducts. In which case, the outlet ducts, which are preferably straight, extend transversally relative to their respective inlet ducts by forming an angle or a bend. Technically, it is then necessary to offset the outlet ducts so that they extend parallel, side by side or one above the other. Of course, with this type of head, the dispenser orifice(s) are located in the plane containing the actuator rods. But, in order to obtain balanced pressures on the head, it is necessary to press about half way between the two actuator rods. Nevertheless, in so doing, dispensing takes place laterally, which is highly unsatisfactory.

SUMMARY

The present invention seeks to remedy or at least to overcome the above-mentioned problem of the prior art by defining a dispenser head that is easy to make and in which the outlet duct(s) and their associated dispenser orifices are located between the two coupling sleeves in such a way that the fluid mixture is dispensed substantially along the finger(s) used to press on the dispenser head. Of course, in this case, the outlet ducts cannot be connected directly to their respective coupling sleeves.

U.S. Pat. No. 6,305,578 describes a dispenser with an actuator head that comprises two coupling sleeves, a dispenser endpiece, and a connecting cross member. The cross member connects the sleeves to the end-piece. Said cross member defines a connection duct connecting the inlet ducts formed by the sleeves to an outlet duct formed by the end-piece. The connection duct extends transversally relative both to the inlet ducts and to the outlet ducts. The connection duct includes two access openings which are closed by additional closure elements.

The present invention aims at simplifying the manufacture and assembly of the dispenser head.

In order to achieve this aim, the present invention provides a dispenser head for assembly on two parallel, hollow actuator rods, said head being made as a single piece of plastics material and comprising two parallel coupling sleeves for engaging with respective ones of the actuator rods, the sleeves defining respective inlet ducts, a dispenser endpiece defining at least one outlet duct discharging into at least one dispenser orifice, and a cross member linking the sleeves to the endpiece, the cross member defining at least one connection duct linking the inlet ducts to the outlet duct(s), said at least one connection duct extending transversally both relative to the sleeves and relative to the outlet duct(s), said at least one connection duct including one access opening closed by a closure element, the dispenser head being characterized in that the closure element is made integrally with the remainder of the head.

As in the document U.S. Pat. No. 6,305,578, the cross member provides the junction between the inlet ducts and the outlet duct(s). They are very difficult to reach, given that they are not in line either with the inlet ducts or with the outlet duct(s). That is why this access opening is provided, thereby greatly facilitating molding, or more generally, manufacturing the head. Then, once the head has been manufactured, the access opening is closed in a leaktight manner by the closure element. Advantageously, the access opening is located at one axial end of the connection duct so that a molding core can be introduced via the opening and pushed up to the other end of the duct, going in succession past an inlet duct and an outlet duct. Of course, the molding core may be a molding core which is introduced in the dispenser head mold during manufacture. The molding core may then be withdrawn by disengaging it through the access opening. The molding core comes into contact with two other molding cores allowing for the molding of the respective inlet and outlet ducts.

In an embodiment, the closure element is hinged on the head. Advantageously, the closure element pivots about an axis between an open position and a closed position. In a practical embodiment, the closure element comes in the form of a pivoting flap flexibly connected to the remainder of the head by a bridge. Preferably, the flap includes a sealing stud to be inserted by force into the access opening. The dispenser head may thus be manufactured in one piece, for example by injecting plastic into a mold, combining the two coupling sleeves, the cross member, the end-piece, and the two leaktight closure flaps.

In a practical embodiment, the dispenser head includes two outlet ducts and two connection ducts, each linking an inlet duct with an outlet duct, each connection duct being provided with an access opening and a closure element located at opposite ends of the cross member. Thus, each access opening gives access to a blind connection duct whose blind end communicates with a respective outlet duct. Given that the coupling sleeves are located rather on or near the ends of the cross member, each molding core enabling a connection duct to be formed comes into contact firstly with the molding core forming the inlet duct and then with the molding core forming the outlet duct.

With a dispenser head of this structure or design, the dispenser endpiece is located approximately or accurately in the centre of the cross member, i.e. midway between the two coupling sleeves. As a result, by pressing on the dispenser head in the middle of the cross member, pressure is evenly applied, and if the actuation can be performed with one finger, dispensation takes place in line with the finger, which is quite natural.

The present invention also provides a pusher comprising such a dispenser head, the pusher advantageously defining a housing for receiving the head, which housing includes locking means for locking the closure element(s) in the access opening(s).

BRIEF DESCRIPTION OF THE DRAWINGS

The invention is described in greater detail below with reference to the accompanying drawings showing an embodiment of the invention by way of a non-limiting example.

In the Figures.

DETAILED DESCRIPTION OF EXEMPLARY EMBODIMENTS OF THE INVENTION

Figure 1:
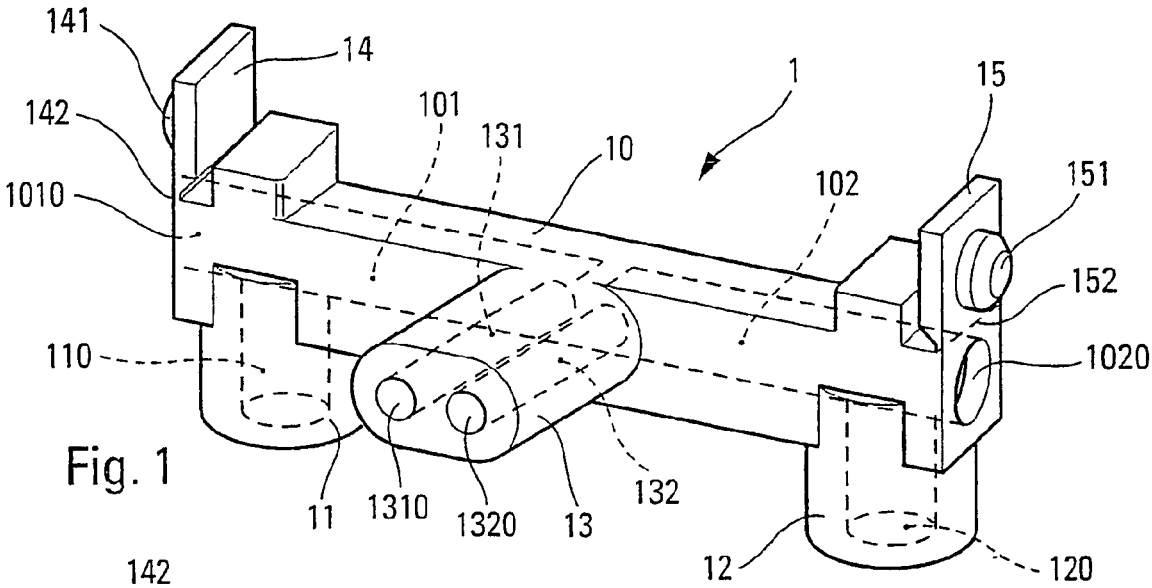
FIG. 1 is a partially transparent perspective view of a dispenser head of the invention when it comes out of the mold.

Reference is made initially to FIG. 1, which shows both the external and internal structure of a dispenser head in one, non-limiting, embodiment of the invention. FIG. 1 corresponds to the state of the dispenser head on coming out of the mold. In fact, the dispenser head can advantageously be manufactured by shaping plastics material in a mold, as is often the case for the parts which go to make up fluid dispensers. Nonetheless, it is also possible to manufacture the dispenser head of the invention by means other than by molding a plastics material.

The dispenser head comprises two coupling sleeves 11 and 12 which extend parallel to each other but at some distance apart, the distance corresponding to the distance between the two hollow actuator rods of two dispenser components (pump or valve) which are assembled on respective fluid containers. In order to simplify matters, the top, free ends of the hollow actuator rods are located at substantially the same level, so that the coupling sleeves 11 and 12 are also located at the same level as each other. Internally, each of the coupling sleeves 11 and 12 defines a respective inlet duct 110, 120, which is preferably straight, and even circular and cylindrical. The actuator rods are coupled to the sleeves 11 and 12 by introducing their top ends into the inlet ducts 110 and 120.

The dispenser head also comprises a cross member 10 which interconnects the two sleeves 11 and 12. Here, the cross member 10 is perfectly straight, but it could also be bent or curved. The coupling sleeves 11 and 12 connect to the cross member 10 at each opposite end of the cross member 10, on its under side. The cross member 10 can thus be said to be supported by the two sleeves 11 and 12 at its two ends. Internally, the cross member 10 defines two advantageously straight connection ducts 101, 102, which communicate directly with the inlet ducts 110 and 120 of the sleeves 11 and 12, respectively. It should be observed that the connection ducts 101 and 120 are not in line with the inlet ducts 110 and 120, but instead extend transversally or even perpendicularly thereto.

The dispenser head also comprises a dispenser endpiece 13 which advantageously connects to the cross member 10 in the middle of said cross member. When the cross member 10 is bent, the dispenser endpiece 13 connects to the cross member 10 at the bend formed by the cross member. Internally, the dispenser endpiece 13 defines two outlet ducts 131 and 132 which are advantageously straight. Each of the outlet ducts communicates via one of its ends, with a respective one of the connection ducts 101 and 102, and at its other free end it defines a respective dispenser orifice 1310 or 1320. Once again, it should be observed that the ducts 131 and 132 are not in line with the connection ducts 101 and 102, but instead extend transversally or even perpendicularly thereto.

Thus, the inlet duct 110 communicates with the outlet duct 131 via the connection duct 101. In a symmetrical manner, the inlet duct 120 communicates with the outlet duct 132 via the connection duct 102. The inlet ducts extend in a vertical plane, whereas the connection and outlet ducts extend in a horizontal plane but in different directions, which are advantageously perpendicular. It can thus be observed that the connection ducts 101 and 102 extend transversally both relative to the inlet ducts 110 and 120 and in relation to the outlet ducts 131, 132. As a result, in practice, it would be very difficult to gain access to the connection ducts 101 and 102, and virtually impossible to mold them.

According to the invention, each connection duct 101, 102 is provided with an access opening 1010, 1020. Preferably, these access openings are located at one end of the connection ducts so that they provide access in rectilinear manner the entire length of the duct. In the embodiment shown in the figures, the access openings 1010 and 1020 are located at the opposite longitudinal ends of the cross member, i.e. adjacent to the coupling sleeve 12. These openings 1010 and 1020 extend in a vertical plane whereas the passage enabling communication between the inlet ducts 110, 120 and the connection ducts 101, 102 extends in a horizontal plane. It is readily understood that it is easy to introduce respective molding cores into the connection ducts 101, 102 through their respective access openings 1010, 1020. Thus it is easy to position the molding cores which make it possible to form the connection ducts 101, 102, and then withdraw them through the openings 1010, 1020. For example, the molding core for the connection duct 102 can thereby come into contact with the free end of the molding core forming the inlet duct 120 in order to create the communication passage between the inlet duct and the connection duct 102. Likewise, the molding core for the connection duct 102 comes into contact, at its free end, with the free end of the molding core for outlet duct 132 in order to create a communication passage between the connection duct and the outlet duct 132.

Figure 2:
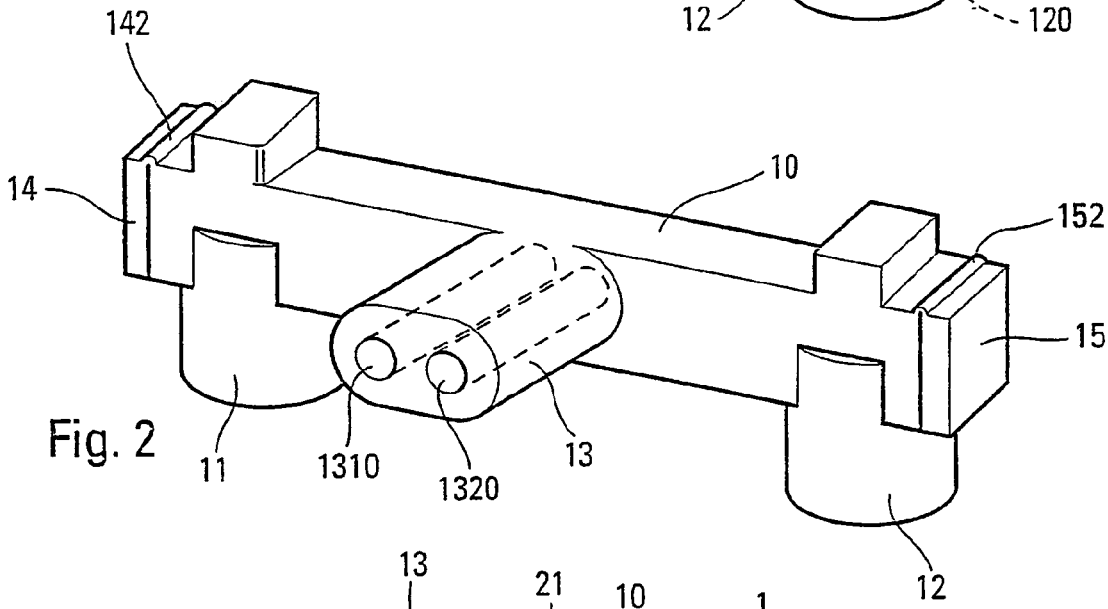
FIG. 2 is a perspective view of the dispenser head in FIG. 1 in a functional state ready for use.

In the invention, these access openings 1010, 1020 are hermetically closed by means of closure elements which act as leaktight stoppers. Advantageously, these closure elements can be manufactured as a single component with the remainder of the dispenser head. In the embodiment shown in the figures, the closure elements come in the form of flaps 14, 15 which are advantageously hinged by pivoting on the remainder of the head. The flaps 14, 15 can pivot advantageously around a rectilinear axis 142, 152 embodied by bridges of flexible material that serve to connect the flaps to the remainder of the head. In the embodiment shown in the figures, the flaps 14 and 15 are connected to the cross member 10 at the edges of the opposite top ends located just above the access openings 1010, 1020. Each of the pivoting flaps 14, 15 advantageously forms a respective sealing stud 141, 151 adapted to be engaged by force into the respective openings 1010, 1020. By hinging the flaps to pivot about stationary axes, it is possible to position the studs 141 and 151 in precise and centered manner relative to the two access openings. In FIG. 1, the dispenser head is shown in a configuration corresponding to that which it has on leaving the mold, i.e. with the flaps 14 and 15 extending in a vertical plane above the cross member 10. In FIG. 2, the flaps 14 and 15 have been folded down by being pivoted about their respective axes 142, 152 so that they become located in line with the opposite ends of the cross member 10. The sealing studs 141 and 151 are then engaged in leaktight manner in the openings 1010, 1020 which are thus hermetically closed. The dispenser head as shown in FIG. 2 is then ready for operation.

It should be observed that the dispenser head of the invention can be manufactured as a single component, i.e. a component combining the coupling sleeves 11 and 12, the cross member 10, the endpiece 13, and also the two closure flaps 14 and 15. The method of connecting the closure elements 14 and 15 to the remainder of the head, implemented in this example by an advantageously pivoting hinge, constitutes merely one advantageous embodiment but it is not the only one. Moreover, the dispenser head shown in the drawings and described above includes two connection ducts 101 and 102, each provided with a respective access opening 1010, 1020. Likewise, the dispenser endpiece 13 shown includes two outlet ducts 131 and 132. It is however possible to manufacture a dispenser head with only one outlet duct, and thus with only one dispenser orifice. In this case, the two connection ducts 101 and 102 can be joined together so that they constitute a single connection duct that extends along the entire length of the cross member 10. It is then no longer necessary to provide for two access openings, since one is enough to engage the molding core which would then intercept both inlet ducts 110 and 120 as well as the single outlet duct.

As a variation, it is also possible to envisage embodying access openings not in the form of an opening located at one end of the connection duct 102, but in the form of a lid which gives access to the entire length of the connection duct. It is then possible to imagine that the cross member 10 could be provided with two pivoting lids located on its top face or on its rear face so that it is possible to mold the duct 102 and the inlet duct 120 or the outlet duct 132 with a single molding core. Moreover, when there is only one outlet duct, the cross member 10 can be fitted with one longitudinal lid extending practically the entire length of said cross member so that, with a single molding core, it is possible to mold both inlet ducts 110 and 120, as well as the single connection duct.

Figure 3:
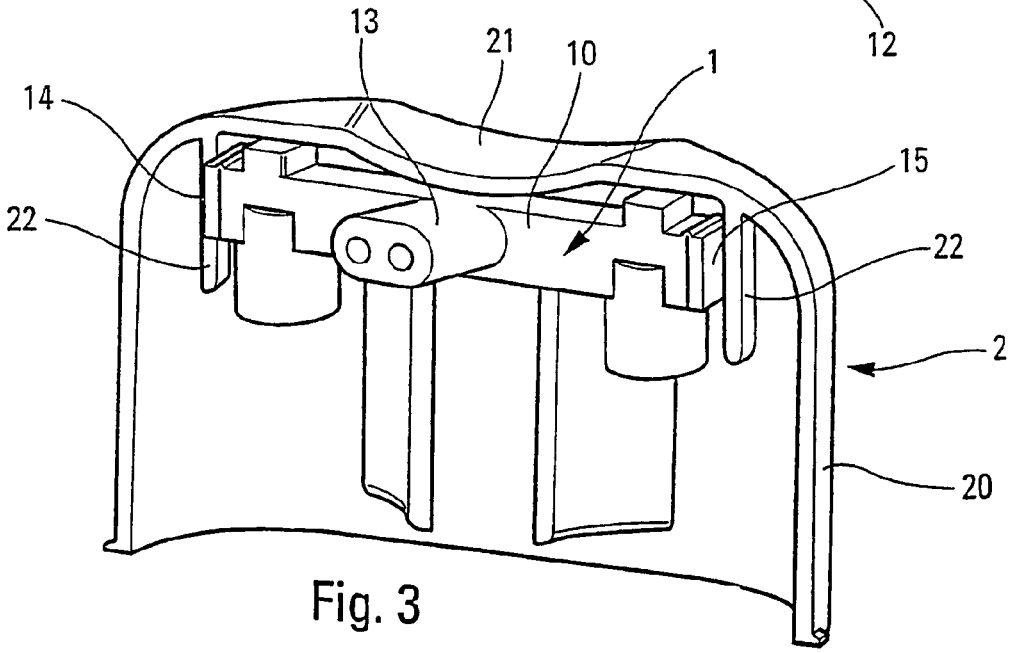
FIG. 3 is a partially cut away view of a pusher incorporating a dispenser head of the invention.

FIG. 3 shows the dispenser head in FIGS. 1 and 2 integrated inside a pusher 2 intended to overlap the dispenser components (pump and valve in the "duo" dispenser). The pusher 2 comprises a substantially-cylindrical peripheral skirt 20 and a top wall forming a bearing surface 21, which can be depressed with one or more fingers. It should be observed that the bearing surface 21 is located substantially in the centre or in the middle of the cross member 10 level with the dispenser endpiece 13. The pusher 2 forms an internal housing adapted to receive the dispenser head 1. Advantageously, the internal housing includes two locking catches 22 for coming into contact with the closure flaps 14 and 15 in such a manner as to lock them in the position shown in FIG. 2, i.e. with their sealing studs firmly engaged in the access openings. It is thus impossible for the flaps to disengage from their associated access openings, which might lead to major leaks. Of course, it is also possible to guarantee that the head is leaktight at the flaps by using conventional sealing techniques such as adhesive or heat sealing.

The invention makes it possible to provide a dispenser head for a "duo" dispenser as a single component whose dispenser outlet is located between the two actuator rods of the dispenser member.

The invention claimed is:

1. A dispenser head (1) for assembly on two parallel, hollow actuator rods, said head being made as a single piece of plastics material and comprising:

two parallel coupling sleeves (11, 12) for engaging with respective ones of the actuator rods, the sleeves defining respective inlet ducts (110, 120);

a dispenser endpiece (13) defining at least one outlet duct discharging into at least one dispenser orifice (1310, 1320); and a cross member (10) linking the sleeves to the endpiece, the cross member defining at least one connection duct (101, 102) linking the inlet ducts (110,120) to the outlet duct(s) (1310, 1320), said at least one connection duct extending transversally both relative to the sleeves and relative to the outlet duct(s), said at least one connection duct (101, 102) including an access opening (1010, 1020) closed by a closure element (14, 15), and wherein the closure element (14, 15) is made integrally with the remainder (10, 11, 12, 13) of the head;

and wherein the access opening is located at one axial end of the connection duct so that a molding core can be introduced via the opening and pushed up to the other end of the duct, going in succession past an inlet duct and an outlet duct.

2. A dispenser head according to claim 1, in which the closure element (14, 15) is hinged on the head.

3. A dispenser head according to claim 2, in which the closure element (14, 15) pivots about an axis (142, 152) between an open position and a closed position.

4. A dispenser head according to claim 3, in which the closure element comes in the form of a pivoting flap (14, 15) flexibly connected to the remainder of the head by a bridge (142, 152).

5. A dispenser head according to claim 4, in which the flap (14, 15) includes a sealing stud (141, 151) for inserting by force into the access opening (1010, 1020).

6. A pusher (2) including a dispenser head (1) according to claim 1, said pusher defining a housing to receive the head, said housing including means for locking (22) the closure element in the access opening.

7. A dispenser head for assembly on two parallel, hollow actuator rods, said head being made as a single piece of plastics material and comprising:

two parallel coupling sleeves for engaging with respective ones of the actuator rods, the sleeves defining respective inlet ducts;

a dispenser endpiece defining at least one outlet duct discharging into at least one dispenser orifice; and a cross member linking the sleeves to the endpiece, the cross member defining at least one connection duct linking the inlet ducts to the at least one outlet duct, said at least one connection duct extending transversally both relative to the sleeves and relative to the at least one outlet duct, said at least one connection duct including an access opening closed by a closure element, wherein the closure element is made integrally with the remainder of the head; and wherein the dispenser head comprises two outlet ducts (1310, 1320) and two connection ducts (101, 102) each linking an inlet duct (110, 120) with an outlet duct (1310, 1320), each connection duct being provided with a respective access opening (1010, 1020) and a respective closure element (14, 15) located at opposite ends of the cross member (10).

* * * * *